US007229044B2

(12) United States Patent
Niederer

(10) Patent No.: US 7,229,044 B2
(45) Date of Patent: Jun. 12, 2007

(54) COMPENSATING DISK TENSION CONTROLLER

(75) Inventor: Kurt W. Niederer, Charlotte, NC (US)

(73) Assignee: Texkimp Limited, Cheshire (GB)

( * ) Notice: Subject to any disclaimer, the term of this patent is extended or adjusted under 35 U.S.C. 154(b) by 14 days.

(21) Appl. No.: 10/518,207

(22) PCT Filed: Jun. 13, 2003

(86) PCT No.: PCT/GB03/02577

§ 371 (c)(1),
(2), (4) Date: Dec. 16, 2004

(87) PCT Pub. No.: WO04/000709

PCT Pub. Date: Dec. 31, 2003

(65) Prior Publication Data

US 2005/0224625 A1 Oct. 13, 2005

Related U.S. Application Data

(60) Provisional application No. 60/389,777, filed on Jun. 19, 2002.

(51) Int. Cl.
*B65H 59/24* (2006.01)

(52) U.S. Cl. ..... 242/419.4; 242/150 R

(58) Field of Classification Search ..... 242/149, 242/150 R, 419, 419.4
See application file for complete search history.

(56) References Cited

U.S. PATENT DOCUMENTS 1,965,363 A * 7/1934 Abbott ..... 242/150 R
2,637,511 A * 5/1953 Heijnis ..... 242/149
2,715,505 A * 8/1955 Atkins ..... 242/150 R
5,335,878 A * 8/1994 Jacobsson ..... 242/150 R

FOREIGN PATENT DOCUMENTS

DE 2119880 A * 11/1971
JP 49020466 A * 2/1974
JP 60082571 A * 5/1985

* cited by examiner

*Primary Examiner*—Patrick Mackey
*Assistant Examiner*—William E. Dondero
(74) *Attorney, Agent, or Firm*—Adams Evans P.A.

(57) ABSTRACT

An improved tension controller for a strand to achieve constant downstream tension regardless of tension variation in the upstream strand has a pair of tensioning plates (9, 10) between which the strand upstream (3), downstream (5) is compressed, generating frictional force for added tension. A selectable loading force is applied to the controller in the opposite direction to the movement of the strand. This loading force acts on a wedge between a movable tensioning plate and a fixed plate (9). The angle between the fixed plate (9) and the strand between the tensioning plates generates a compression force at a right angle toward the compressed strand for added tension. The incoming strand is deflected before it reaches its compressed stage between the tensioning plates. This strand deflection generates a force-component in the direction of the strand movement and reduces the loading force correspondingly. By proper selection of the wedge angle, the reduction of the loading force results in a reduction of the added tension by the same amount.

12 Claims, 19 Drawing Sheets

COMPENSATING DISK TENSION CONTROLLER

This is a national phase application of International Application PCT/GB03/002577, filed Jun. 13, 2003, and claims priority to U.S. patent application Ser. No. 60/389,777, filed Jun. 19, 2002. This invention relates to an apparatus and method for controlling the tension in moving yarns. More specifically, it compensates for varying tension over the time of a process and results in consistent strand tension, which is often desirable for the next downstream process.

Numerous types of tension devices are known for the purpose of increasing the tension in a travelling strand. These include mostly devices which add tension to the traveling yarn. Some of them apply pressure to the traveling yarn, which in turn adds tension, based on the product of applied force times the friction coefficient. Others deflect the traveling strand around one or several posts and through these deflections increase the tension depending on the bending angle and the friction coefficient between the traveling strand and the bending surface.

More sophisticated strand tensioning systems use complex and expensive electronic means to measure the strand tension and electronically vary the applied tension with a close-loop feedback to achieve constant output tension. Their high cost prohibits their application for most, but extremely sensitive applications.

The invention disclosed in this application employs a tension device consisting of two friction plates between which the strand travels. It achieves constant output tension by reducing the applied tension between these two friction plates by the same value as the amount of upstream tension of the yarn. Since the total downstream tension is the sum of the tension upstream of the tension device and the tension added by the tension device, the downstream tension in the disclosed invention is constant.

In accordance with a first aspect of the present invention there is provided a strand tension apparatus, comprising:

(a) a strand delivery mechanism for delivering a moving strand (3) downstream from a strand supply (2);

(b) a strand take-up mechanism (7) positioned downstream from the strand delivery mechanism for pulling the strand (5) from the strand supply;

(c) a tension controller (1) positioned between the strand delivery mechanism and the strand take-up mechanism for adding tension to the moving strand as it moves downstream to the strand take-up mechanism, the tension controller including a pair of tensioning plates consisting of a stationary tensioning plate (9) and a second, movable tensioning plate (10), between which plates the moving strand passes; and (d) an adjustable loading force applied to the movable tensioning plate in opposite direction to the movement of the strand generating through geometric restriction a force component perpendicular to the direction of the moving strand perpendicular to the direction of the moving strand in the region of the tensioning plates; and (e) means to deflect the upstream strand entering the tension controller, generating in the tension controller a deflection force of which a force vector is directed in opposite direction of the adjustable loading force for a reduction of the added tension to the strand.

For further details of how we define the apparatus in terms of protective scope the reader is now referred to claims 2-11 hereafter.

In a preferred method of this invention, a wedge is pushed between a fixed cam-surface and one of the two friction plates which in turn pinches the moving strand with the second, fixed friction plate. The moving strand is deflected around the movable friction disk and its upstream tension opposes the pushing force of the wedge, hence reducing the compression force on the moving strand. A constant output tension is achieved by selecting the proper ramp angle for this wedge.

Preferably there is provided a strand tension controller for maintaining substantially uniform strand tension for delivery to a downstream strand processing station.

Preferably there is provided a strand tension controller which allows to set a desired tension level and tension uniformity downstream from the strand tension controller.

Preferably there is provided a strand tension controller which includes means for uniformly and simultaneously setting the strand tension on a plurality of yarns being processed.

Preferably there is provided a multiple set of strand tension controllers for which the desired tension level in all yarns can be changed simultaneously to fit a specific need in a downstream strand processing station.

Preferably there is provided a multiple set of strand tension controllers for which the desired tension level in all yarns can be changed simultaneously. Preferably the arrangement is such that each unit can be fine-adjusted individually to make it suited for specific needs in a downstream strand processing station.

These and other features of the present invention can be achieved, wholly or in part, by providing a strand tension controller with provision for reducing a compression force of the tension controller to the strand to achieve a desired tension. If the incoming strand has no tension, the full compression force is applied by the tension controller to the yarn. If the incoming strand has tension, the compression force is accordingly reduced.

The compression force may be provided to the tension device by mechanical means.

The compression force may be provided to the tension device by fluidic means.

The compression force may be provided to the tension device by electrical means.

The compression force may be provided to the tension device by means of permanent magnets.

In the preferred embodiments disclosed below there is provided a mechanical strand tension controller, comprising a strand guiding entrance which partially deflects the incoming strand around the movable tensioning plate and guides the strand between a stationary tensioning plate and a movable tensioning plate, a force applying spring, a wedge between the movable tensioning plate and a stationary cam surface and a strand exiting guide. The spring pushes the wedge between the fixed cam surface and the movable tensioning plate and exerts a compression force on the traveling strand between the two tensioning plates. The compression force of the spring may be partially relieved through the resulting deflection force of the incoming strand to achieve a substantially constant output tension in the downstream strand.

Preferably the invention uses common tension-disks, as used in most tension devices.

The invention will now be further described, by way of example, in the accompanying drawings, in which.

Figure 1:
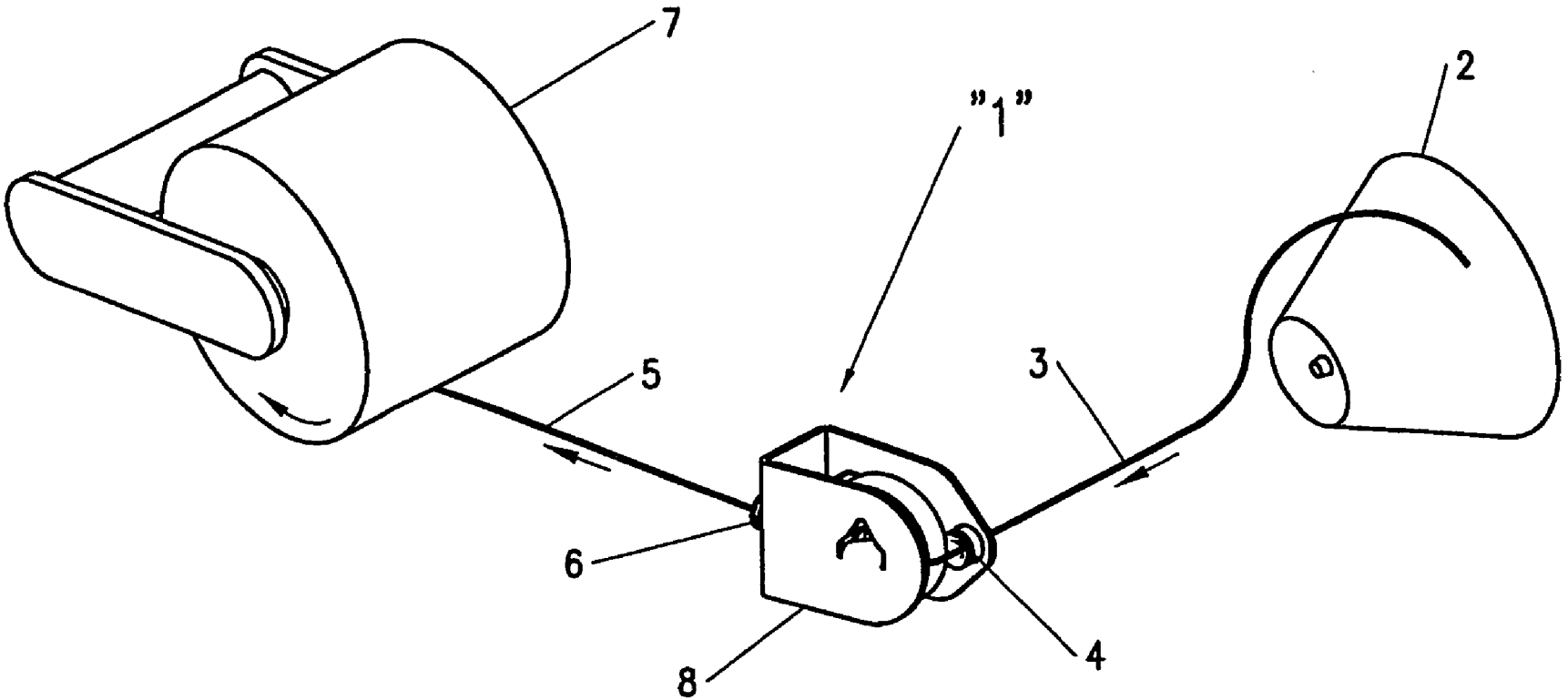
FIG. 1 is a perspective view of the tension controller according to one embodiment of the invention.

Referring now specifically to the drawings, a tension controller 1 is broadly illustrated in FIG. 1 as a part of a strand tension apparatus, including a strand supply and take-up mechanism. A supply package 2 dispenses of the upstream strand 3 which enters into the tension controller 1 through an entrance guide 4. The downstream strand 5 exits the tension controller 1 through the exit guide 6 to be wound up by the take-up package 7.

Figure 2:
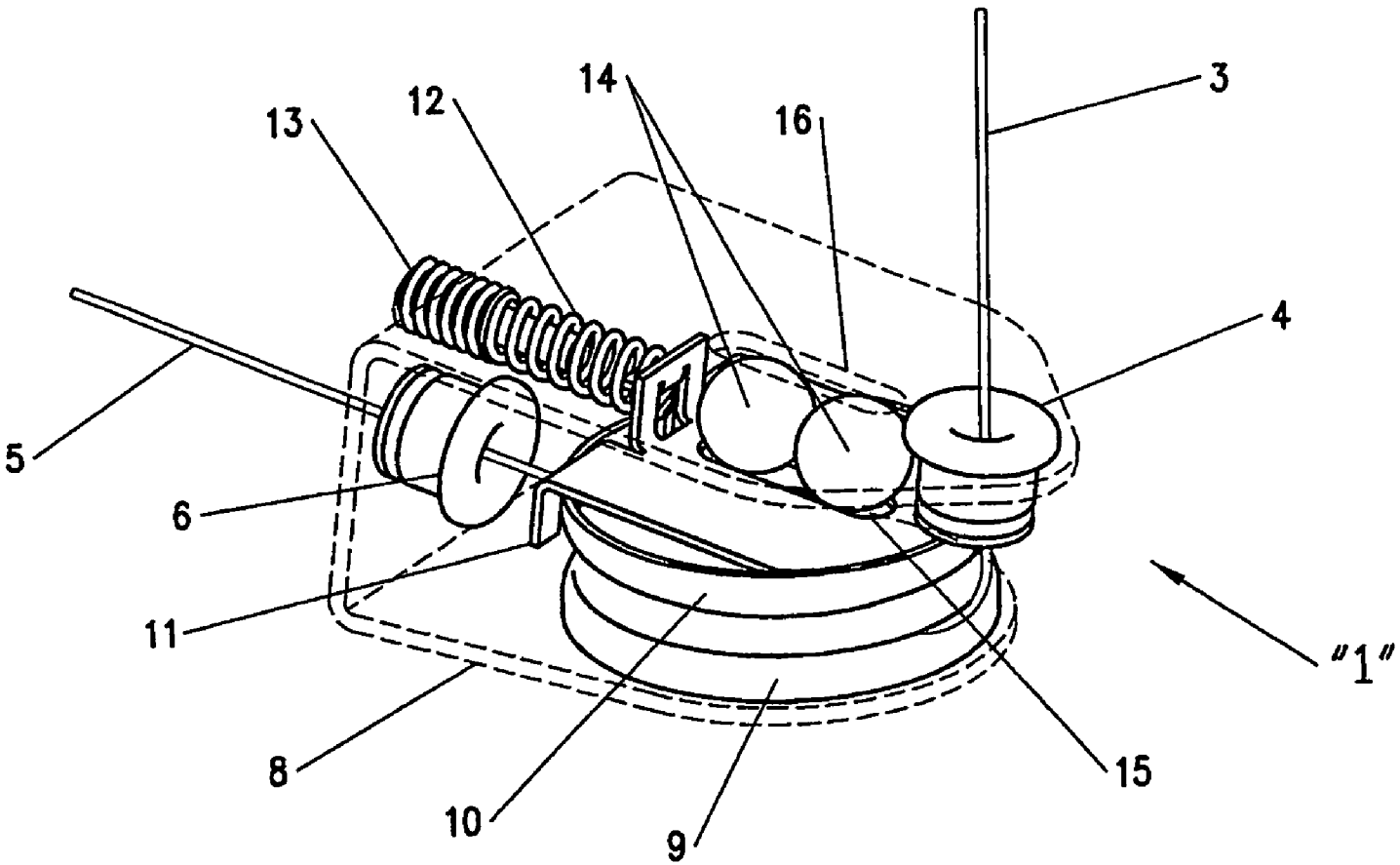
FIG. 2 is an overall perspective view of the tension controller with a view of the path of the strand from the supply to the take-up according to an embodiment of the invention.

Referring now to FIG. 2, a perspective view shows the tension controller 1 having a bracket 8, shown transparent for clarity. A stationary disk 9 is shown, located below a movable disk 10. A wedge plate 11 is locked in place inside the movable disk 10. A setting spring 12 is held on one side by a set-screw 13 which is inserted in a bore in the bracket 8. The other side of the setting spring 12 pushes against the wedge plate 11. Two balls 14 are located between a wedge slot 15 in the wedge plate 11 on one side and in a bracket slot 16 in the bracket 8 in order to reduce the friction between the fixed bracket 8 and the sliding wedge plate 11, which in turn is fastened to the movable disk 10.

Figure 3:
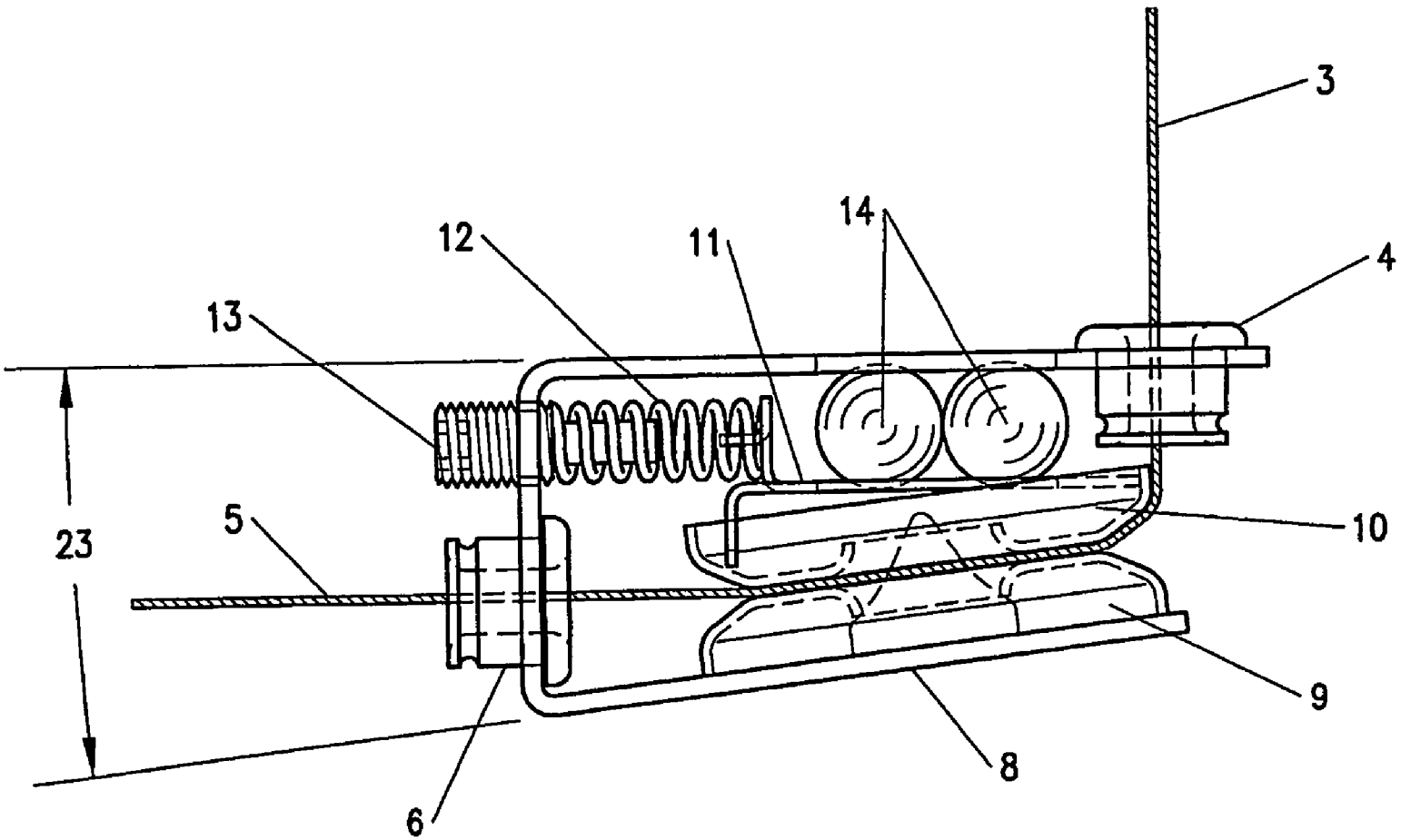
FIG. 3 is a side view of the tension controller with the strand exiting to the left.

In FIG. 3 the same parts are shown in front view. Especially noteworthy is the wedge angle 23, which plays an important role in the function of the tension controller.

Figure 4:
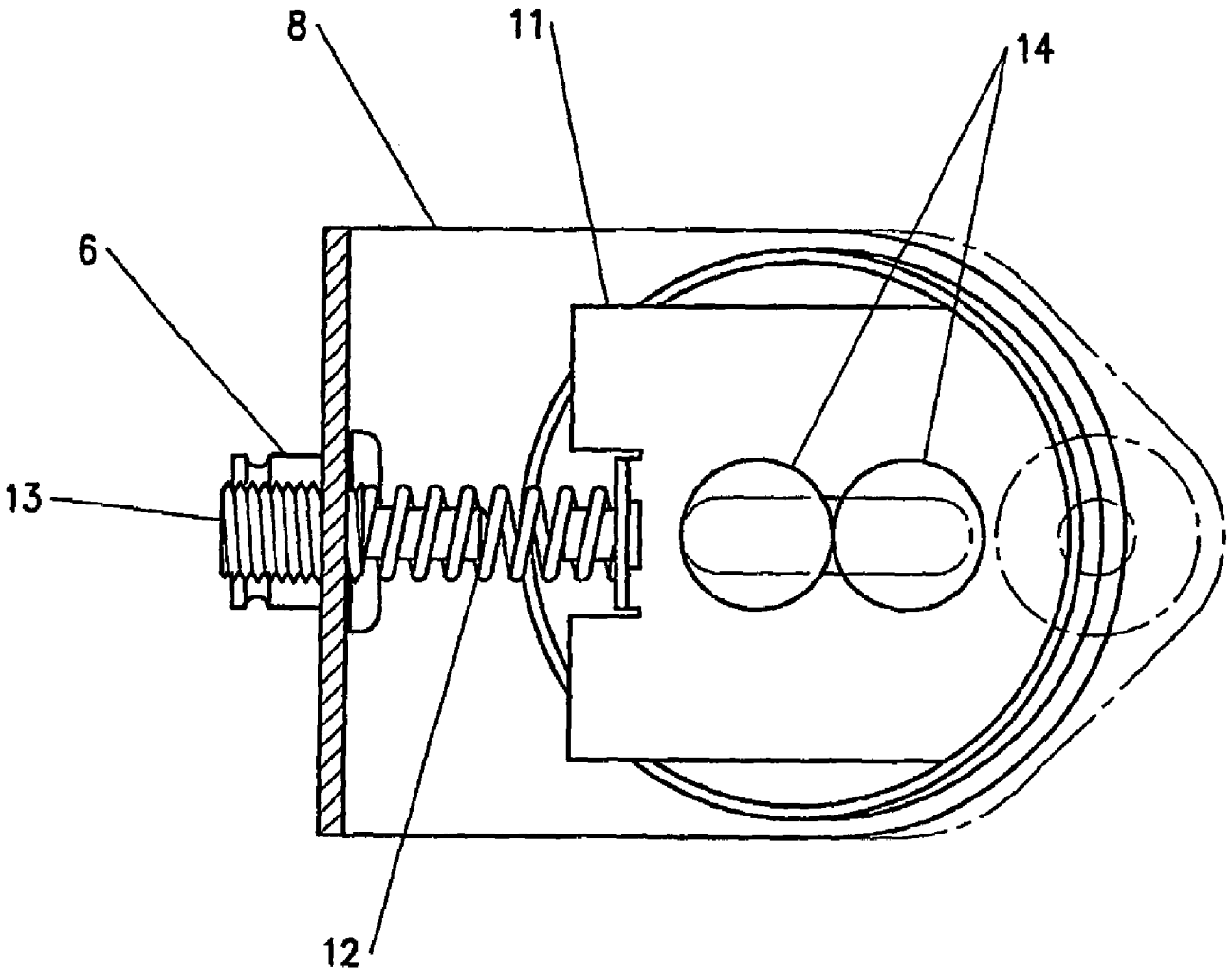
FIG. 4 is a top view of the tension controller with the top part removed to show the inside of the tension controller.

Referring now to FIG. 4, a top-section of the tension controller 1 is shown with the top part of the bracket 8 removed.

Figure 5:
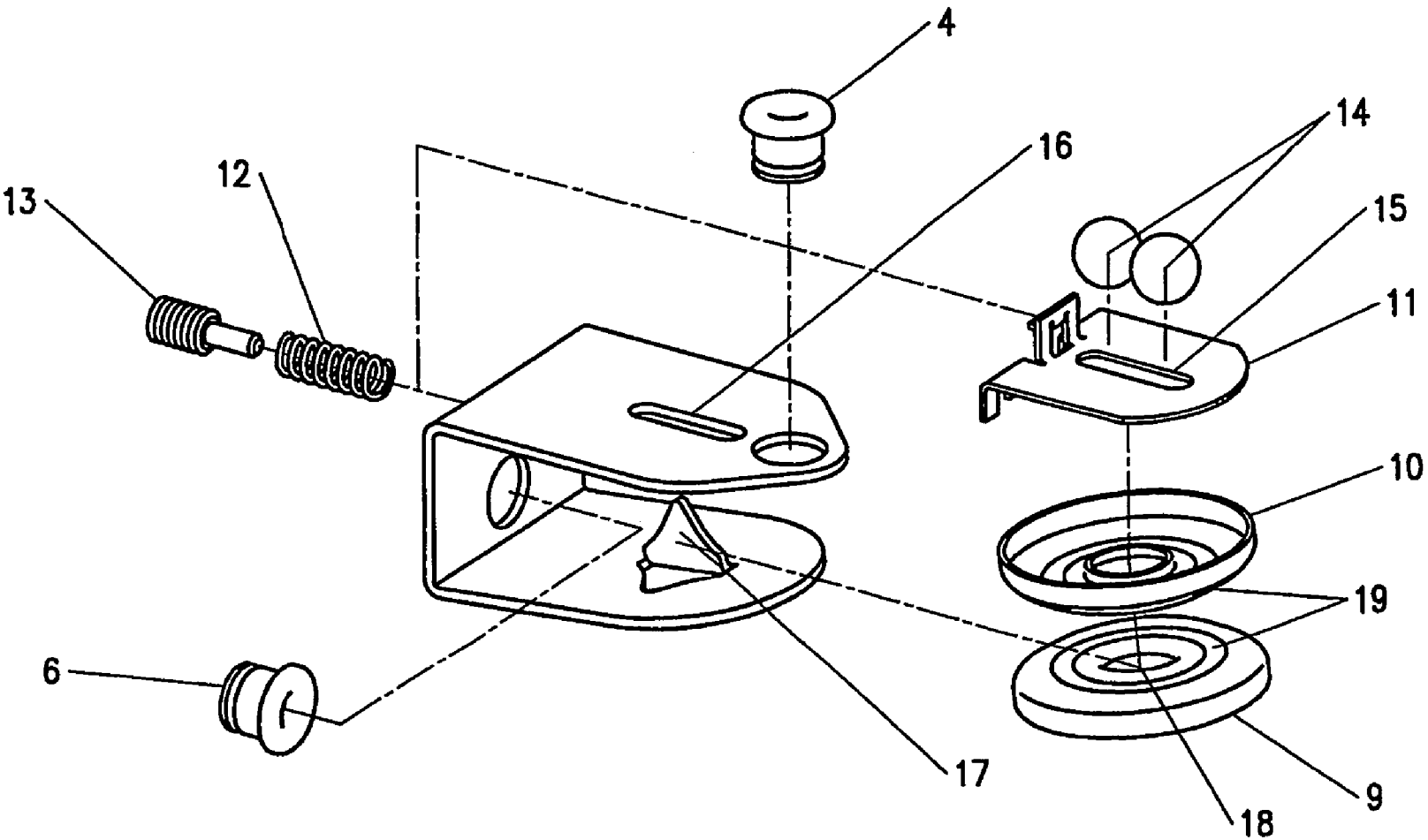
FIG. 5 is an exploded view of the tension controller with all parts shown. Center lines connect the individual parts to facilitate the understanding of how the parts fit together.

FIG. 5 is an exploded view of the tension controller 1 with all parts shown. Center lines connect the individual parts to facilitate the understanding of how the parts fit together. It also shows the self-adjusting mounting of the stationary disk 9 which fits with its center hole 18 onto the bracket horn 17 of the bracket 8. This assures an even contact between the two contact surfaces 19 of the stationary disk 9 and the movable disk 10.

Figure 6:
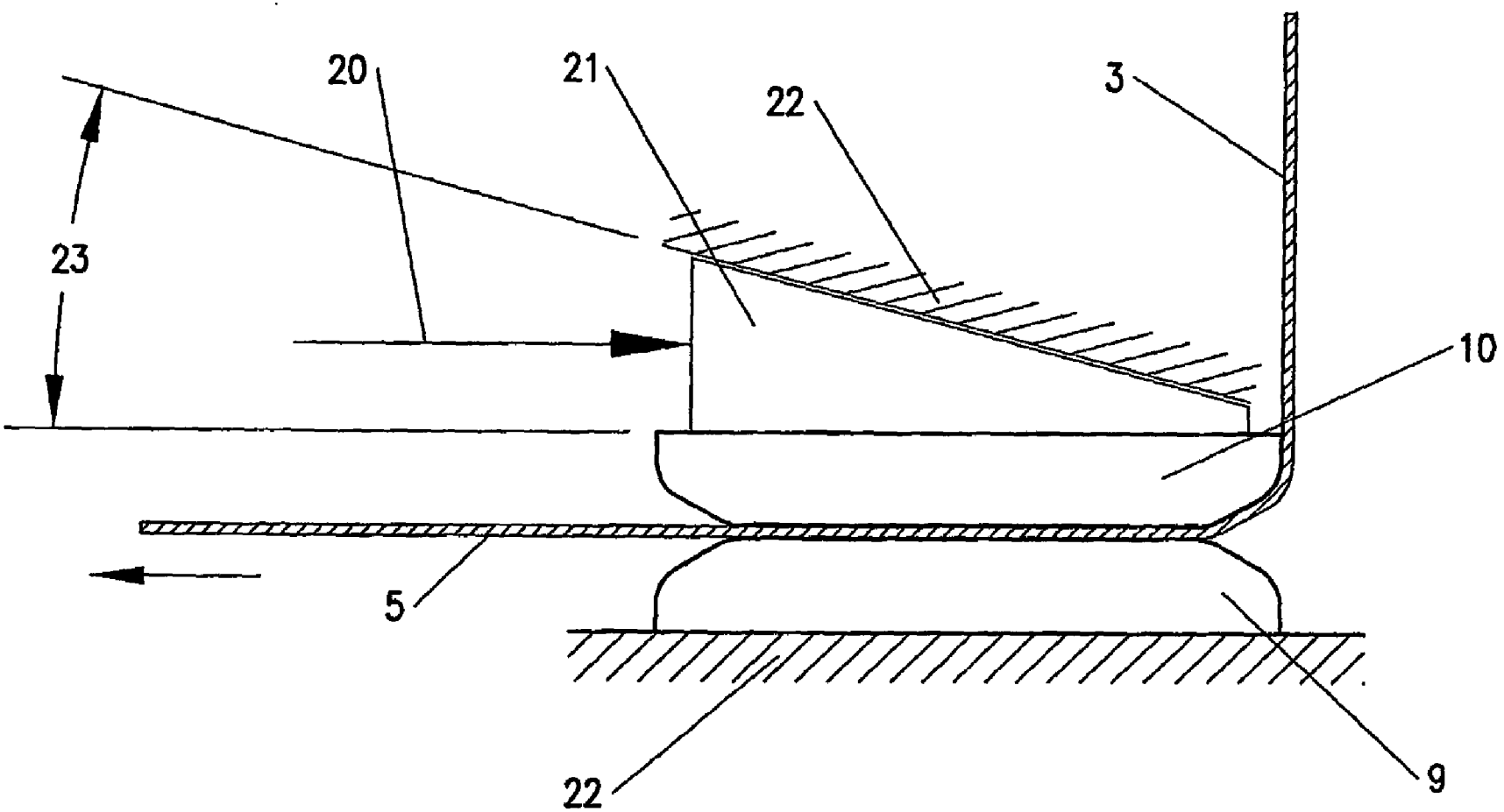
FIG. 6 is a simplified cross-sectional view of the tension controller with the inserted strand and the adjustable loading force applied to a wedge.

Referring to FIG. 6, a schematic drawing of the tension controller shows the tension wedge 21 symbolizing the wedge plate 11 (not shown). The shaded surfaces 22 are stationary surfaces. The adjustable loading force 20 is acting on the tension wedge 21 which has a wedge angle 23. The upstream strand 3 is bent around the movable disk 10 and is compressed between the movable disk 10 and the stationary disk 9 and the downstream strand 5 proceeds to the take-up package 7 (not shown).

Figure 7:
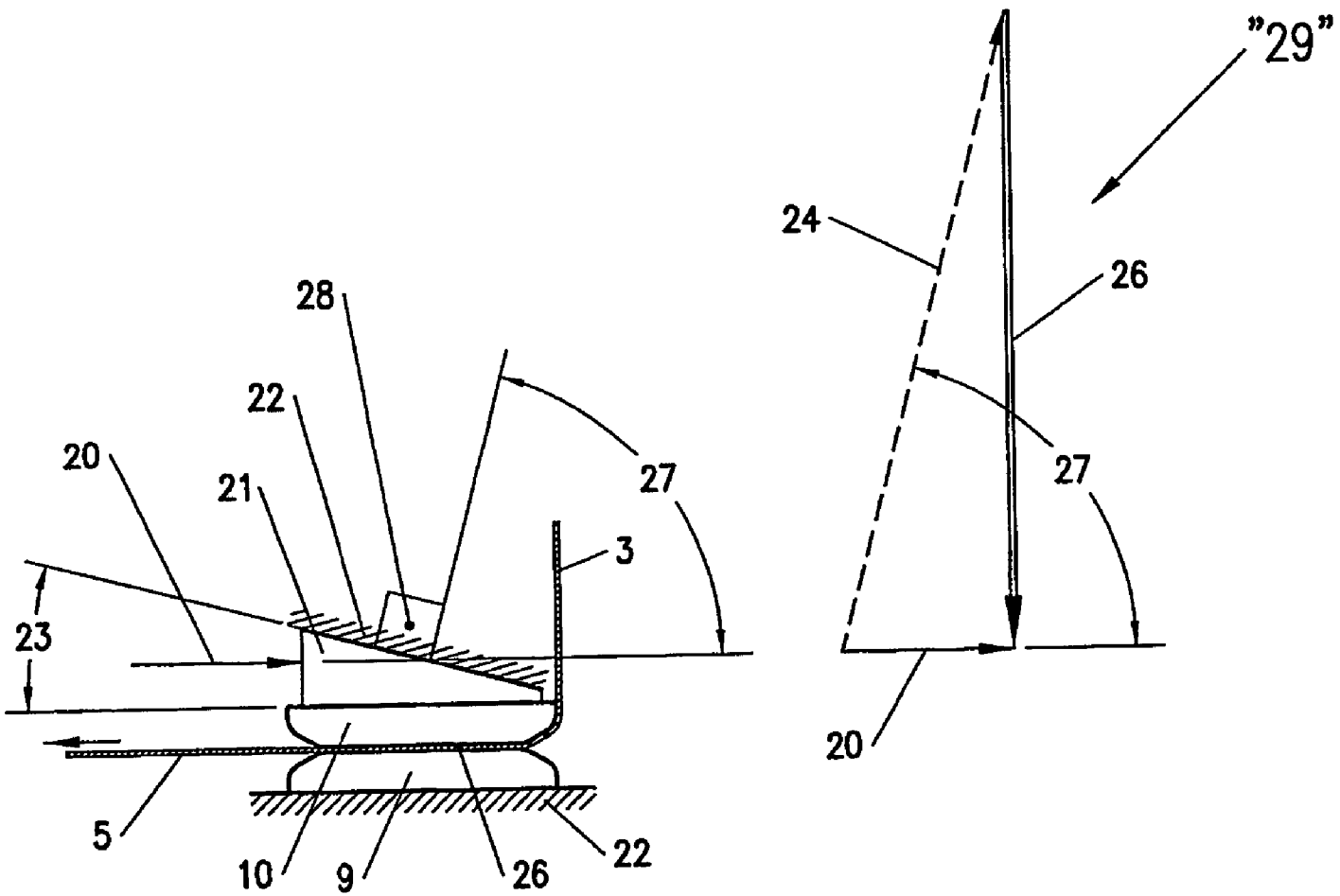
FIG. 7 is a force diagram with zero upstream tension and shows how the loading force is generating the compression acting on the tensioning plates.

The schematic drawing FIG. 7 of the tension controller 1 together with a force diagram 29 demonstrates how the adjustable loading force 20 is acting on the tension wedge 21. The loading force 20 is broken down into the two force components, a normal force 24 and a compression force 26. The normal force 24 is taken up by the stationary surface 22 and has no effect on the strand 25. The compression force 26 acts on the strand 25 by compressing it between the movable disk 10 and the stationary disk 9. It should be noted that the force angle 27 is equal to the difference between 90° and the wedge angle 23. The symbol 28 denotes a right angle of 90°. It is assumed in this drawing that the upstream strand 3 has zero tension.

Figure 8A:
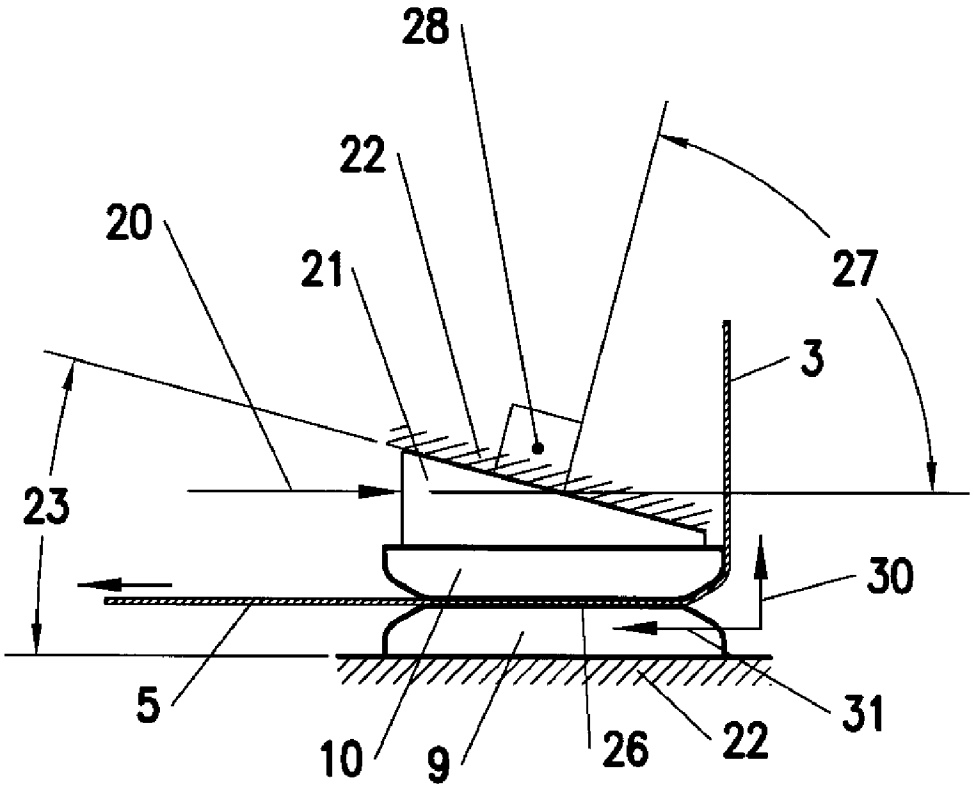
FIG. 8 is a force diagram with nominal upstream tension and shows how the loading force is reduced by the upstream tension.

Referring to FIG. 8A the same adjustable loading force 20 is acting on the tension wedge 21. In addition it shows the up-stream tension 30 in the upstream strand 3 with its resulting strand tension 31. It should be realized that the value of the strand tension 31 is larger than the value of the up-stream tension 30 due to the frictional forces added during the passing of the strand 5 around the movable disk 10.

Figure 8B:
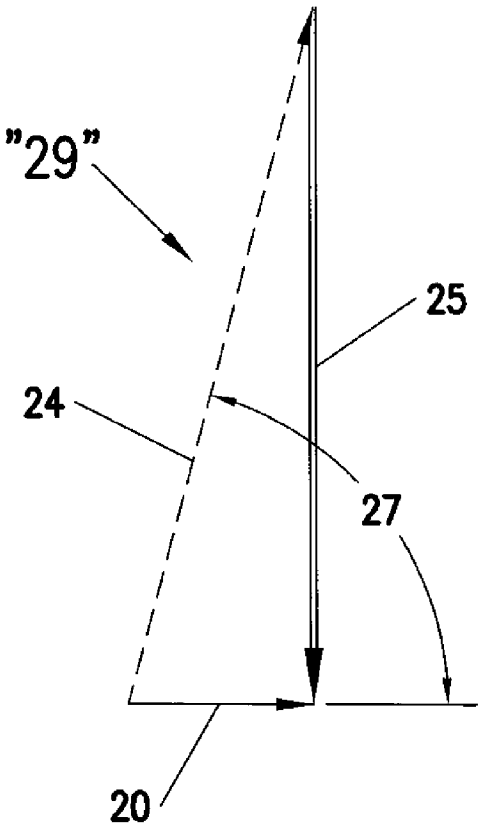

FIG. 8B shows the force triangle of the adjustable loading force 20 with force angle 27, resulting in a compensation force 25.

Figure 8C:
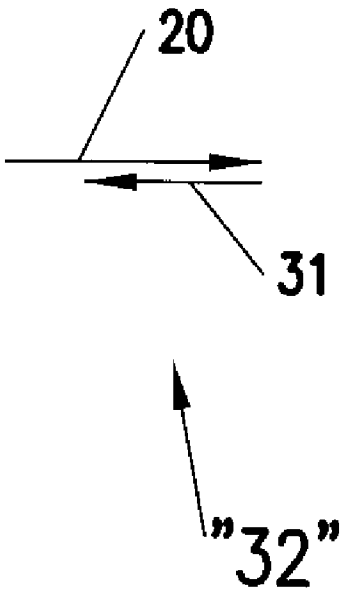

As shown in FIG. 8C, the force reduction 32 is accomplished by the adjustable loading force 20 which is reduced by the component of the strand tension 31.

Figure 8D:
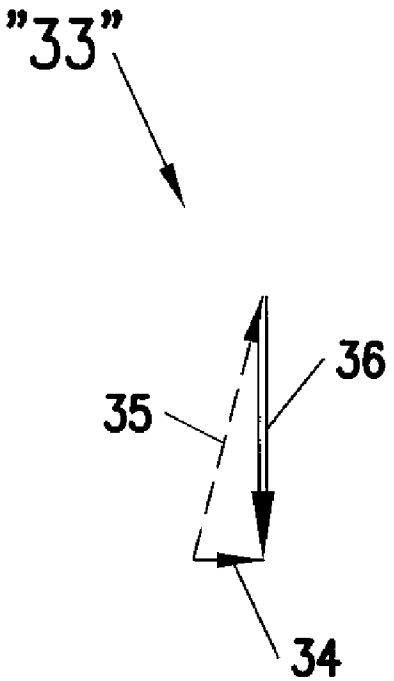

FIG. 8D demonstrates through the resultant force diagram 33 how the reduced loading force 34 results in a reduced normal force 35 with the consequence of a reduced compression force 36.

Figure 9:
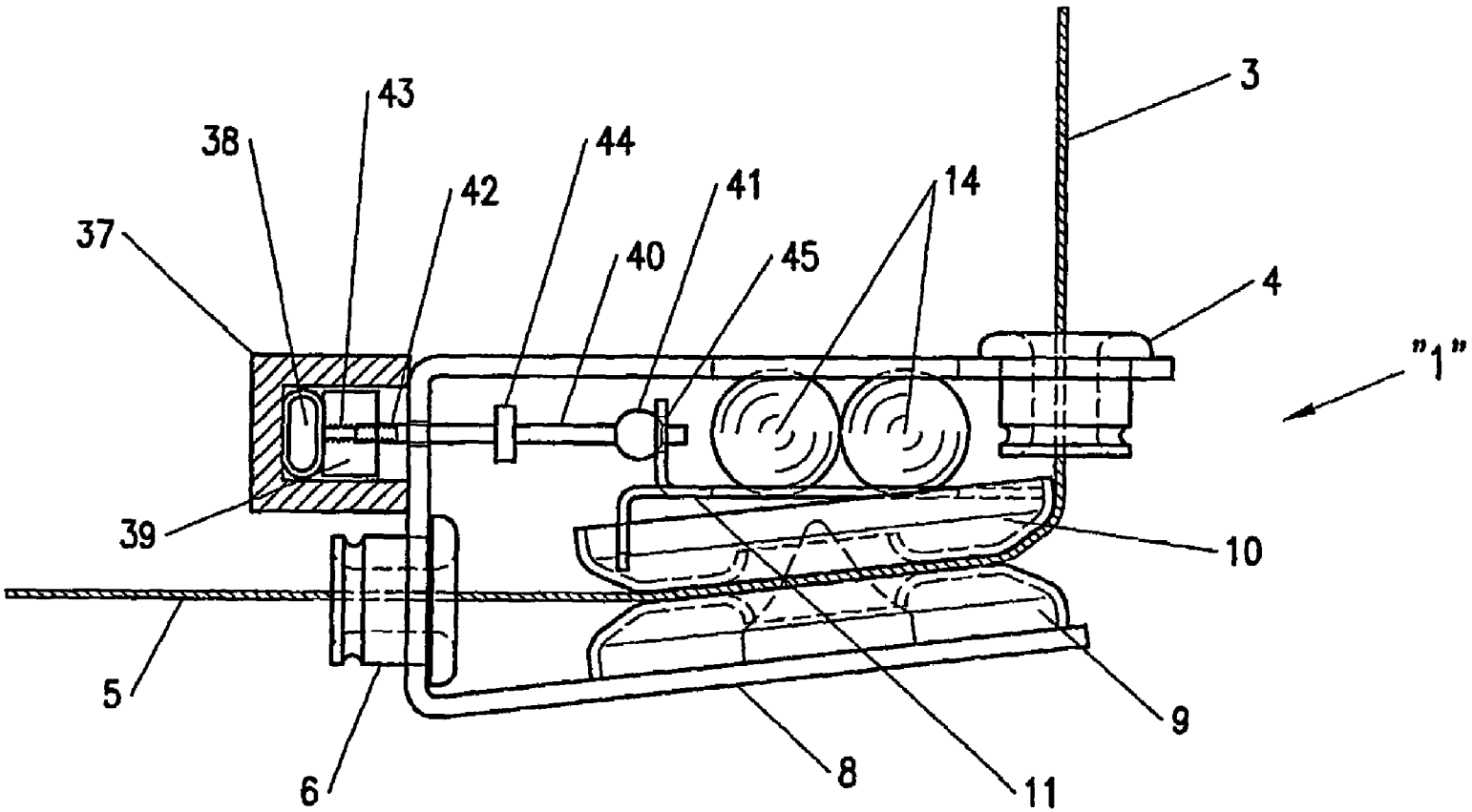
FIG. 9 is a sectional front view of the tension controller with central setting of the loading force through an air tube.

Referring now to FIG. 9, the wedge plate 11 is loaded by an air pressure system. A U-channel 37 contains an elastic air tube 38. It pushes over the pressure anvil 39 through a pressure stem 40 with a ball enlargement 41 against a hole 45 in the wedge plate 11. The pressure anvil 39 is provided with a tap 43 and the pressure stem 40 has a thread 42 which is threaded into the tap 43. An adjustment wheel 44 on the pressure stem 40 allows fine adjustment of the adjustable loading force 20 of each individual tension controller 1. By changing the air pressure in the elastic air tube 38 the adjustable loading force 20 (not shown) on a number of individual tension controller 1, connected to the same air system can be varied simultaneously.

Figure 10:
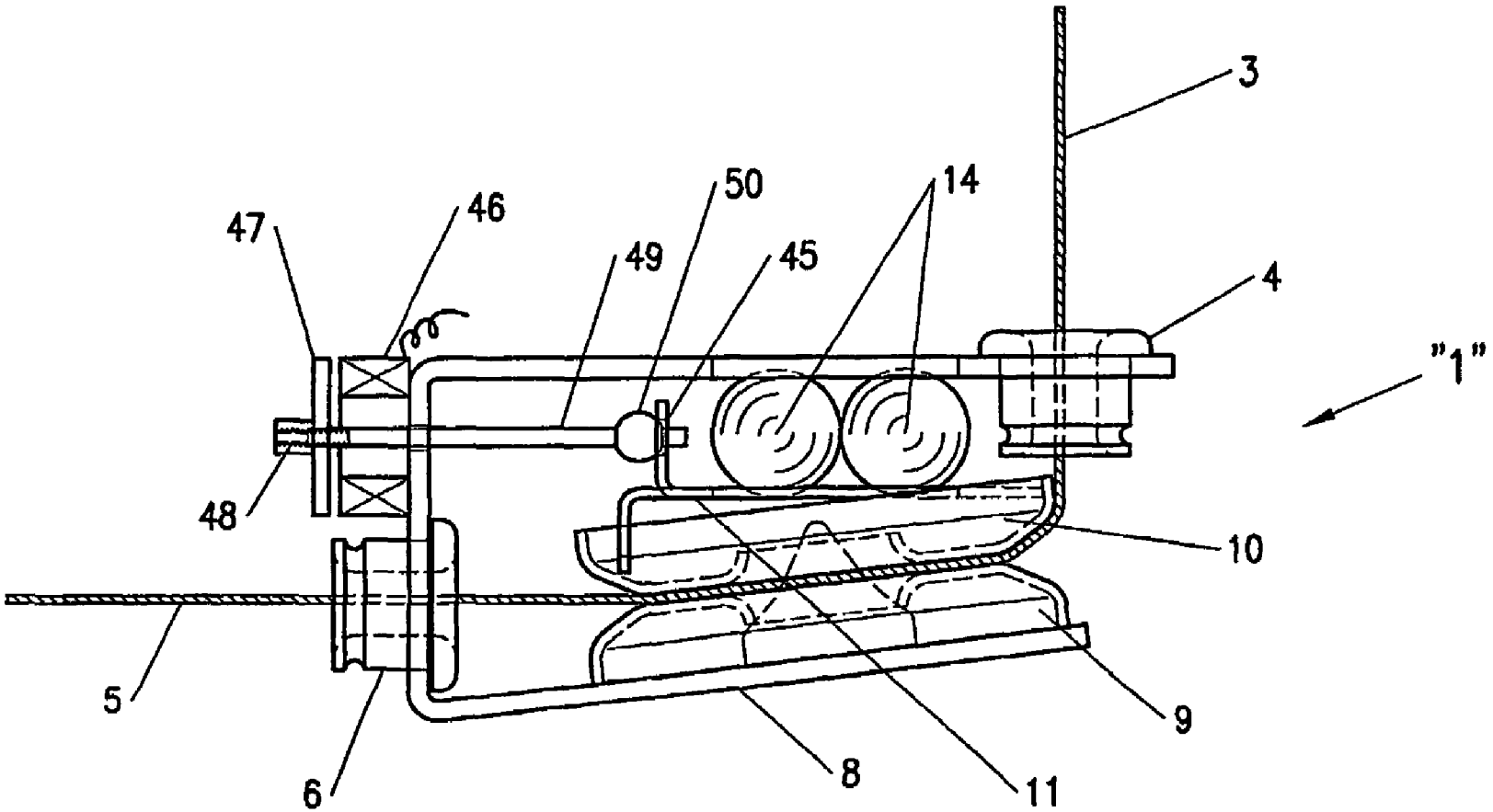
FIG. 10 is a sectional front view of the tension controller with central setting of the loading force through electromagnetic force.

Referring now to FIG. 10, the wedge plate 11 is loaded by electromagnetic force. An electromagnet spool 46 is mounted on the bracket 8. An anvil disk 47, with a disk tap 48, transmits the force through the magnet stem 49, with a stem ball 50, against the hole 45 in the wedge plate 11. Each tension controller 1 can be individually adjusted by turning the anvil disk 47 against the magnet stem 49. Changing the voltage of the electrical supply to the electromagnet spool 46 a number of individual tension controller 1, connected to the same electrical system, can be varied simultaneously.

Figure 11:
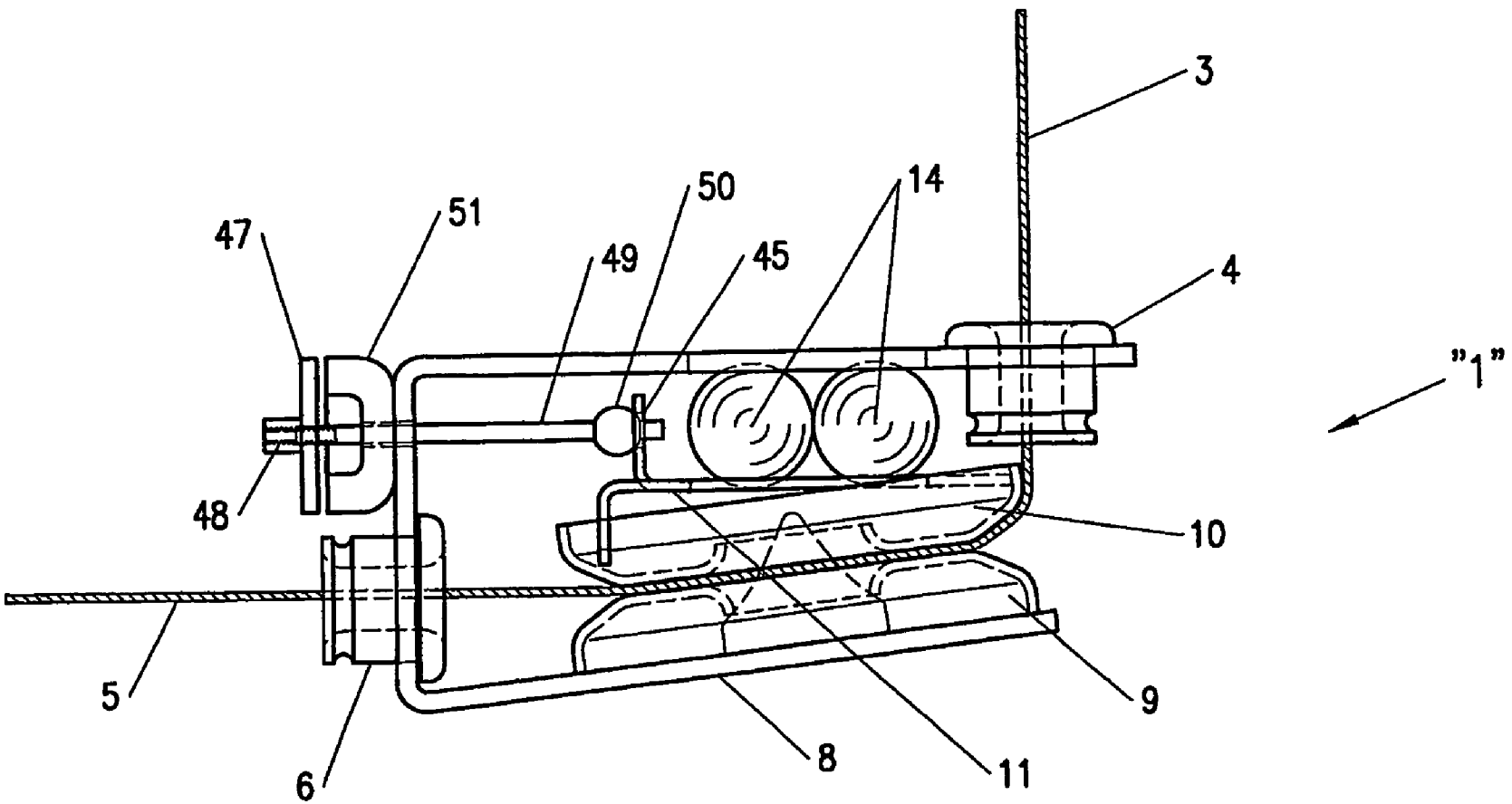
FIG. 11 is a sectional front view of the tension controller with the setting of the loading force through a permanent magnet.

Referring now to FIG. 11, the wedge plate 11 is loaded by a permanent magnet 51. The permanent magnet 51 is mounted on the bracket 8. An anvil disk 47, with a disk tap 48, transmits its force through the magnet stem 49, with a stem ball 50, against the hole 45 in the wedge plate 11. The tension controller 1 can be adjusted by turning the anvil disk 47 against the magnet stem 49.

Figure 12A:
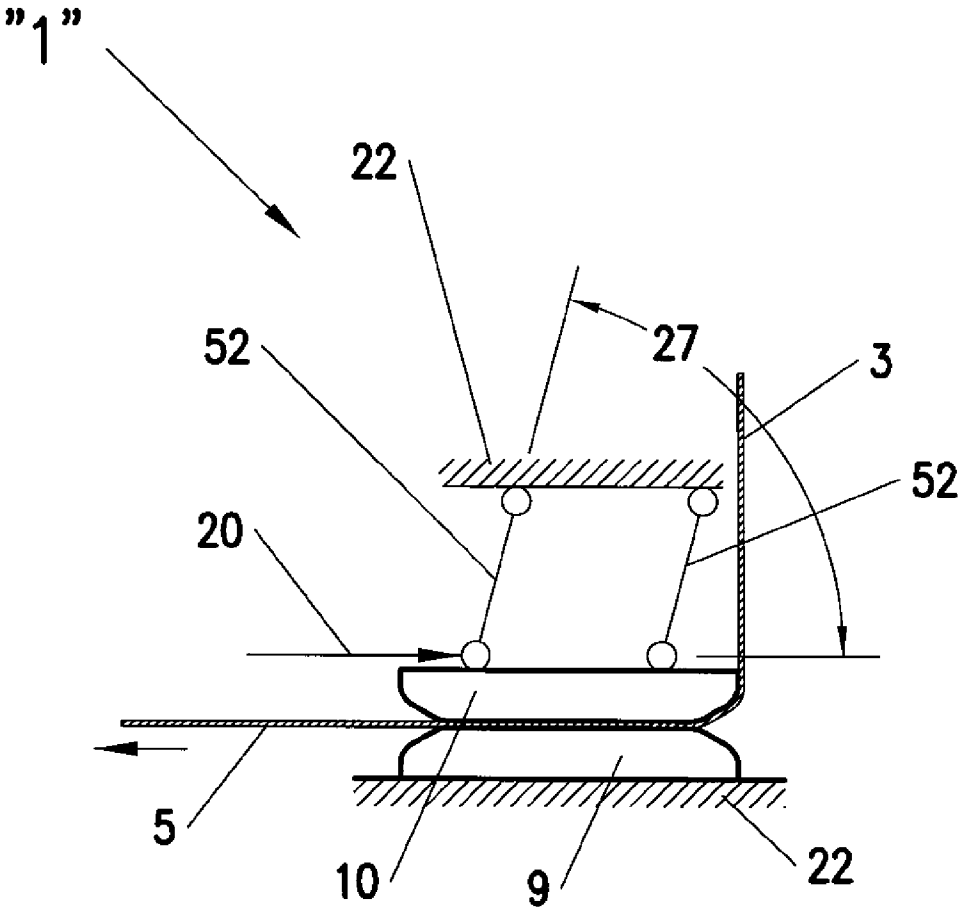
FIG. 12 is an alternate method with the wedge of FIG. 6 being replaced by linkages, achieving similar force characteristics.

The tension controller 1 in FIG. 12A achieves the same force characteristics as shown in FIGS. 6 to 8A-D with pivotal levers 52. Each pivotal lever 52 is pivotally mounted on the stationary surface 22 on one side and on the movable disk 10 on the other side.

Figure 12B:
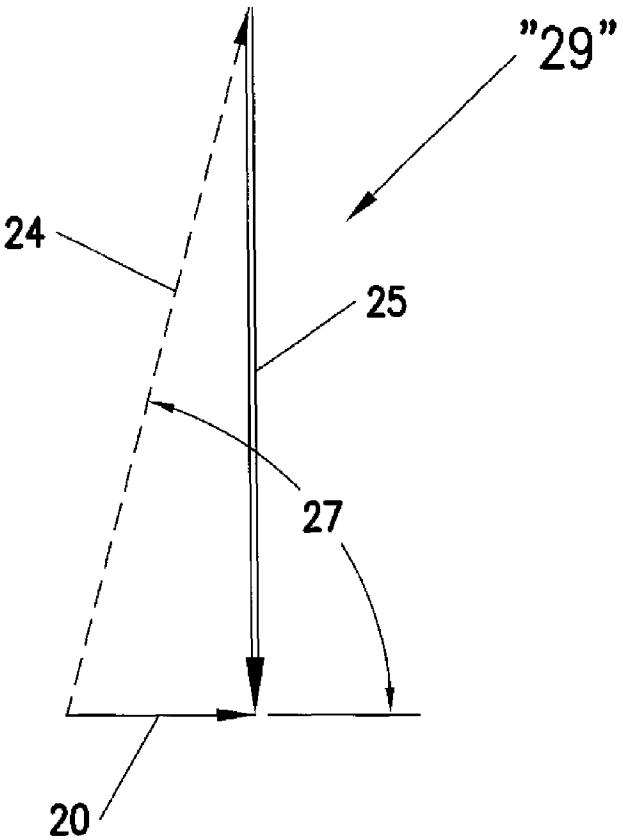

FIG. 12B demonstrates that the same force diagram 29 as in FIG. 8B applies also to this system.

Figure 13:
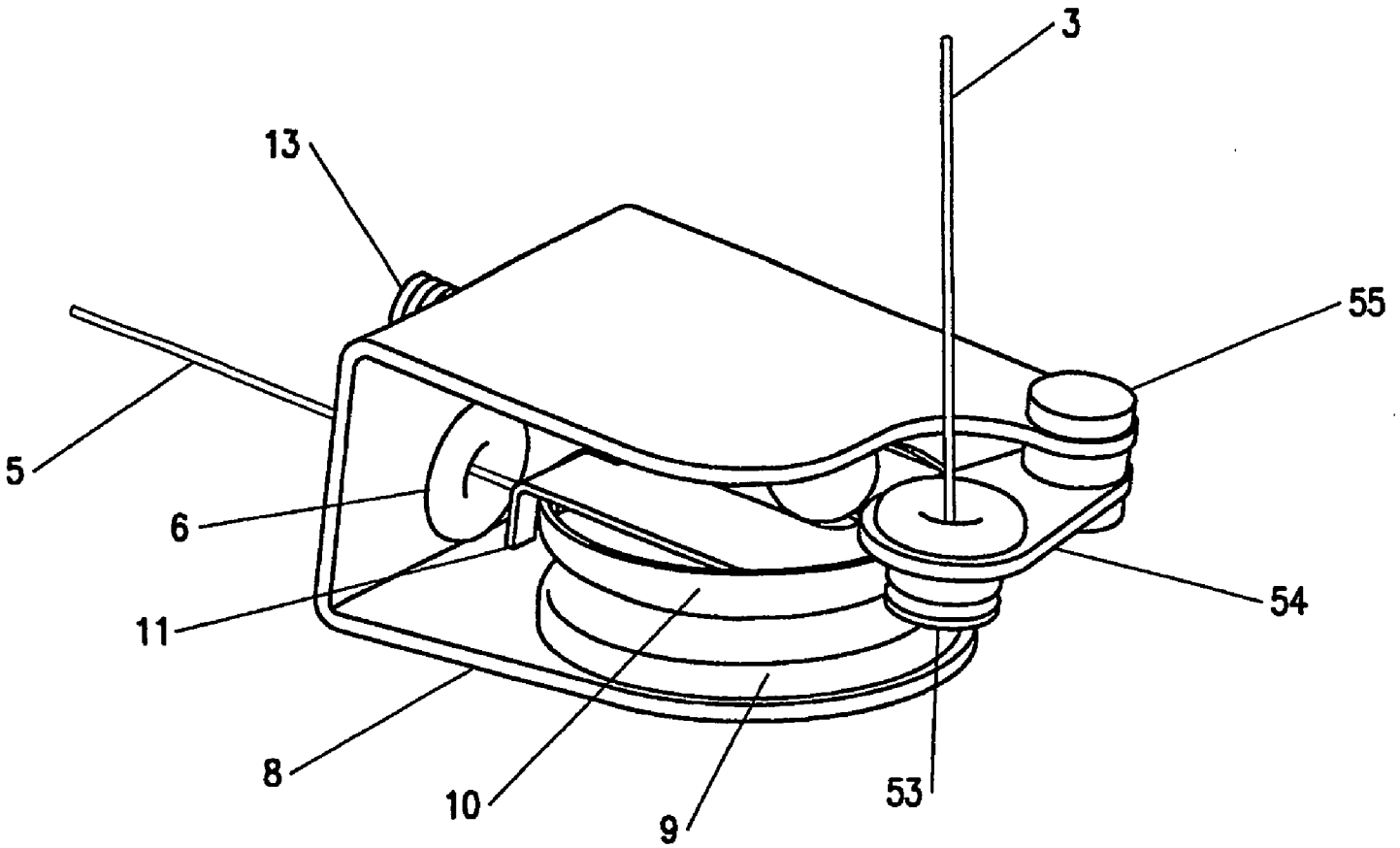
FIG. 13 is a perspective view of the tension controller according to one embodiment of the invention with a floating guide touching the tensioning plate.

Referring to FIG. 13, a floating guide 53 is pushing against the movable disk 10 in order to treat the strand 3 more gently. The disk lever 54 with the floating guide 53 is pivotally mounted on the bracket 8 by the pivot 55.

Figure 14:
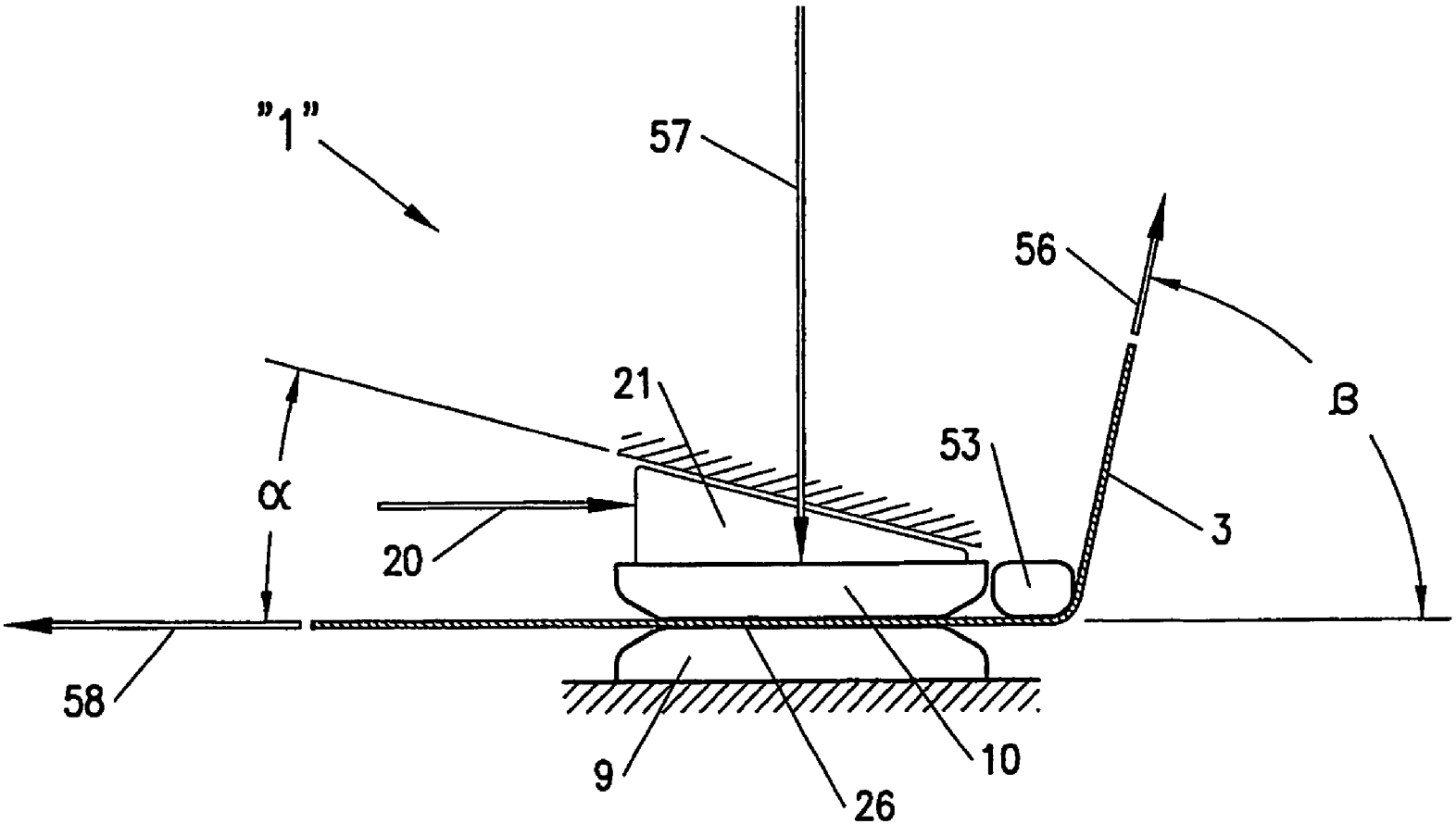
FIG. 14 shows the forces and angles thereof reacting on the tension controller.

FIG. 14 shows the forces as they apply to the tension controller 1. For this tension analysis the tension controller 1 is shown with the floating guide 53 as shown in FIG. 13. The upstream strand 3 is guided around the floating guide and the strand 26 is compressed between the stationary disk 9 and the movable disk 10. The adjustable loading force 20 is applied to the tension wedge 21. By selecting the proper wedge angle "α" for each input angle "β" the tension controller "1" becomes fully compensating for constant output tension 58. It is believed that the following formula is applicable:

$$\tan \alpha = -\mu + 2\mu(e^{\mu\beta} - \cos \beta)/(e^{\mu\beta} - 1)$$

It is understood that "μ" is the friction coefficient between the strand 26 and all surfaces it contacts. It is also understood that if "μ" is not constant, the formula for "tan α" has to be modified correspondingly.

Figure 15:
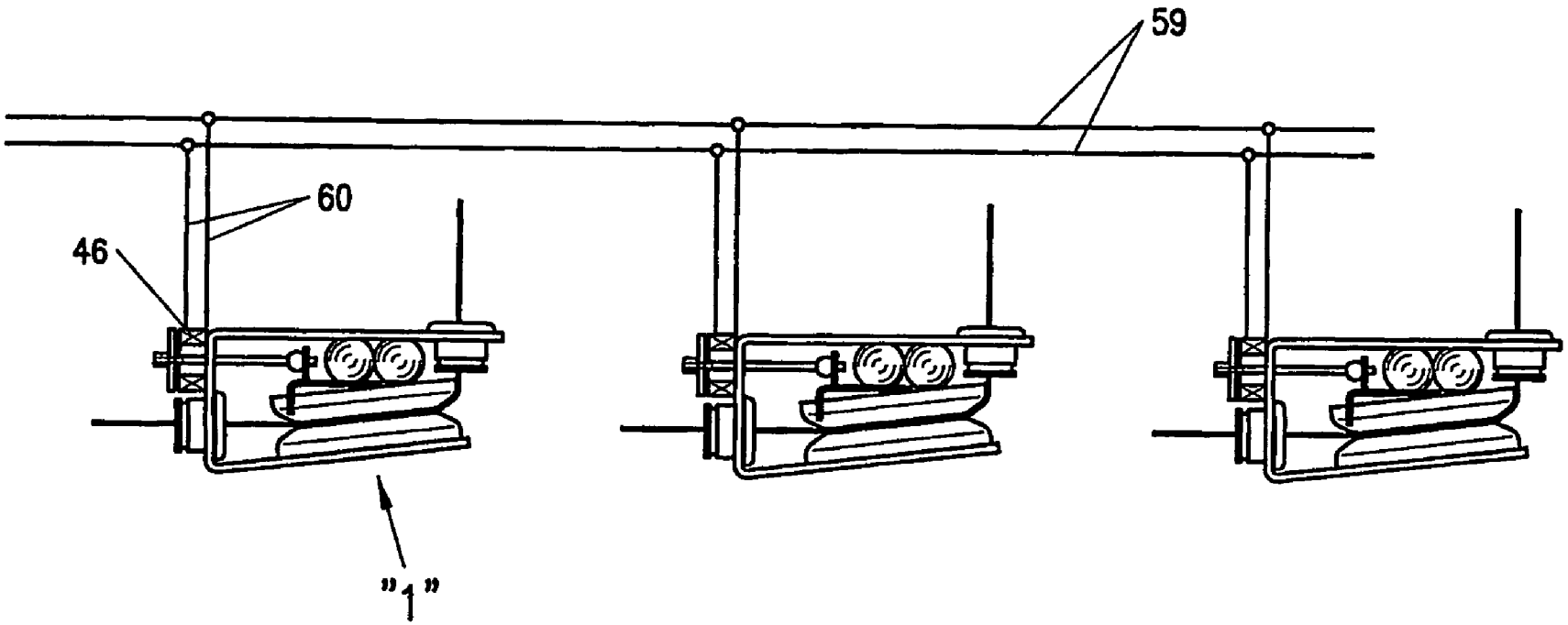
FIG. 15 shows how the tension controllers can be centrally controlled by a common electrical supply.

With respect to FIG. 15, several tension controllers 1 are shown where the electromagnetic spool 46 of each tension controller 1 is connected to a central wiring 59 by means of the branch wiring 60. By changing the voltage in the central wiring, all tension controllers 1 can be set simultaneously.

The invention claimed is:

1. A strand tension apparatus, comprising:

(a) a strand delivery mechanism for delivering a moving strand downstream from a strand supply;

(b) a strand take-up mechanism positioned downstream from the strand delivery mechanism for pulling the strand from the strand supply;

(c) a tension controller positioned between the strand delivery mechanism and the strand take-up mechanism for adding tension to the moving strand as it moves downstream to the strand take-up mechanism, the tension controller including a stationary tensioning plate and a movable tensioning plate, between which plates the moving strand passes;

(d) an adjustable loading force applicator for applying a loading force to the movable tensioning plate in a opposite direction to the movement of the strand and thereby generating through geometric restriction a force component perpendicular to the direction of the moving strand between the stationary tensioning plate and the movable tensioning plate;

(e) an input strand deflector for deflecting the upstream strand entering the tension controller and generating a deflection force that is a function of the tension of the strand as delivered from the strand delivery mechanism; and (f) a tension adjuster positioned to be acted upon by the input strand deflector for generating in the tension controller a deflection force directed in an opposite direction to the adjustable loading force for reducing the tension applied by the tension controller.

2. A strand tension apparatus according to claim 1, where the tension applied to the strand by the compression force between the two tensioning plates is reduced through the force vector of the tension in the upstream strand sufficiently to result in a constant output tension in the downstream strand.

3. A strand tension apparatus according to claim 1 or 2, where the movable plate is restricted in its movement from the stationary plate by a major motion-component in the direction of the down-stream movement of the strand.

4. A strand tension apparatus according to claim 1, wherein the tension adjuster comprises a wedge between the movable tensioning plate and a fixed cam-surface.

5. A strand tension apparatus according to claim 4, wherein the wedge is fastened to the movable tensioning plate with the thinner portion of the wedge pointing in the opposite direction of the movement of the strand; and where the adjustable loading force pushes the wedge against the fixed cam-surface, forcing the movable tensioning plate against the fixed tensioning plate to apply the compression force to the moving strand to increase the downstream tension.

6. A strand tension apparatus according to claim 4, wherein at least one rolling member is positioned between the wedge and the fixed cam-surface to reduce the friction between these two members.

7. A strand tension apparatus according to claim 1, where the upstream tension vector of the moving strand is deflected before entering the space between the two tensioning plates to generate a force opposing adjustable loading force to reduce the tension on the movable strand.

8. A strand tension apparatus according to claim 1, wherein the movable plate is restricted in its movement to separate from the stationary plate by at least one pivoting link (52).

9. A strand tension apparatus according to claims 4 or 8, comprising at least one pivoting link, fastened on one side to the movable tensioning plate and on the other side at a fixed point; wherein the adjustable loading force pushes the movable plate against the fixed cam-surface, forcing the movable tensioning plate against the fixed tensioning plate to apply the compression force to the moving strand to increase the downstream tension.

10. A strand tension apparatus according to claim 1, wherein the movable strand is guided around the movable plate through a floating guide which is free to float in the general direction of the moving strand between the tensioning plates.

11. A strand tension apparatus according to claim 1, wherein the adjustable loading force is generated by a spring.

12. A method of controlling strand tension in a moving strand, comprising the steps of:

(a) feeding the strand downstream between a pair of tensioning plates of a tension controller to add drag to the strand;

(b) apply a loading force to the tension controller in a direction opposite to the movement of the strand between the tensioning plates;

(c) generating through geometric restriction of the loading force a compression force on the pair of tensioning plates to generate additional drag on the strand;

(d) deflecting the strand leading into the tension controller to generate a force-vector of the upstream tension in the strand in the same direction as the movement of the strand between the tensioning plates, and subtracting the force vector from the loading force to reduce in the added drag force, based on the magnitude of the upstream tension of the strand.

* * * * *